US005752484A

United States Patent [19]

Apel et al.

[11] Patent Number: 5,752,484

[45] Date of Patent: May 19, 1998

[54] THROTTLE VALVE DEVICE

[75] Inventors: Peter Apel, Sudkirchen; Klaus Wilczek; Dirk Wuestenbecker, both of Werne, all of Germany; Georg Habel, Coyoacan, Mexico; Ottmar Kappes, Coyoacan, Mexico; Sergio Hector Rangel Cruz, Coyoacan, Mexico

[73] Assignees: AB Elektronik GmbH, Werne, Germany; Bocar S.A. C.V., Coyoacan, Mexico

[21] Appl. No.: 596,248

[22] PCT Filed: Jun. 16, 1995

[86] PCT No.: PCT/EP95/02334

§ 371 Date: Sep. 13, 1996

§ 102(e) Date: Sep. 13, 1996

[87] PCT Pub. No.: WO95/35440

PCT Pub. Date: Dec. 28, 1995

[30] Foreign Application Priority Data

Jun. 18, 1994 [DE] Germany ..... 94 09 891 U
Apr. 6, 1995 [DE] Germany ..... 195 12 916.4

[51] Int. Cl.[6] ..... F02D 9/02; F02D 11/10

[52] U.S. Cl. ..... 123/396; 123/399

[58] Field of Search ..... 123/337, 361, 123/396, 399

[56] References Cited

U.S. PATENT DOCUMENTS

| | | | |
|---|---|---|---|
| 4,947,815 | 8/1990 | Peter | 123/399 |
| 5,014,666 | 5/1991 | Westenberger | 123/399 X |
| 5,146,887 | 9/1992 | Gluchowski et al. | 123/337 |
| 5,325,832 | 7/1994 | Maute et al. | 123/396 |
| 5,343,840 | 9/1994 | Wataya et al. | 123/399 |
| 5,429,090 | 7/1995 | Kotchi et al. | 123/399 X |

FOREIGN PATENT DOCUMENTS

| | | | |
|---|---|---|---|
| 488016 | 11/1991 | European Pat. Off. . | |
| 525376 | 6/1992 | European Pat. Off. . | |
| 651147 | 9/1994 | European Pat. Off. . | |
| 4039937 | 6/1992 | Germany | 123/399 |
| 63-201350 | 8/1988 | Japan | 123/399 |
| 4-284146 | 10/1992 | Japan | 123/399 |
| 2252641 | 8/1992 | United Kingdom . | |

*Primary Examiner*—Tony M. Argenbright
*Attorney, Agent, or Firm*—Furgang & Milde, LLP

[57] ABSTRACT

The invention relates to a throttle valve device including a housing (4; 54; 54'; 98), a throttle valve spindle (3; 53; 53'; 99) on which a throttle valve (2; 52; 52'; 100) movable in the housing (4; 54; 54'; 98) between a first air passage chamber (62; 62'; 92) and a second such chamber (63; 63'; 103) leading to the vehicle engine is held in at least one closed position (DS), an idling position (MS) and a full-throttle position (VS) and a control unit (11; 61; 61'; 107) having at least one control motor unit (5; 55; 55'; 91) and connected to the throttle valve spindle (3; 53; 53'; 99). The second air passage chamber (63; 63'; 103) is connected to a back-up air control device (2, 3, 8, 9, 10, LHP1; 52, 55, 58, LHP2; 52', 55', 58', LHP3; 95, 102) by which enough air can be fed to the engine in the event of the breakdown of the control motor unit (5; 55; 55'; 91) to allow the vehicle movement.

12 Claims, 8 Drawing Sheets

THROTTLE VALVE DEVICE

BACKGROUND OF THE INVENTION

The present invention concerns a throttle valve device. It comprises a housing, a shaft, a valve, two air flowthrough chambers, and a valve positioning assembly. The valve is accommodated between the air flowthrough chambers. The second air flowthrough chamber communicates with the vehicle's engine. The valve positioning assembly is attached to the valve and rotates it between at least one closed position, an idling position, and an all-the-way open position. The valve positioning assembly includes at least one incremental motor. The valves in contemporary throttle valve devices are positioned by stepping motors. The approach is called "drive by wire". The motor is attached to a shaft that rotates inside the housing. The valve can be in a position when the motor fails that will prevent the vehicle from being driven out of the way of other vehicles or to a repair shop.

SUMMARY OF THE INVENTION

The object of the present invention is accordingly to improve a throttle valve device of the aforesaid type to the extent that the vehicle can be driven out of danger or to a repair shop when the motor fails. This object is achieved, in accordance with the present invention, wherein the second air flowthrough chamber communicates with an emergency air supply system that allows the vehicle to be driven away even when the motor fails.

The present invention has several advantages. When the motor fails for example, enough air is always provided to entrain the fuel, which mixes in the form of a fine vapor with the air but does not turn into a gas. The resulting mixture will ignite and can be conventionally employed, and the vehicle can be driven although at low speed.

There are three different embodiments of the present invention, each characterized by the design of its emergency air supply system.

The first embodiment is characterized by an emergency air supply system wherein the valve positioning assembly accommodates a valve return spring and an opposing valve opening spring, both of which fit the shaft tightly, such that the valve return spring is tensioned against a stop as long as the motor maintains the shaft rotated in the opening direction, and such that the valve opening spring is tensioned against the stop as long as the motor maintains the shaft rotated into the idling direction, whereby the valve will assume a position when the motor fails that will allow enough air through for the vehicle to be driven.

This embodiment ensures that the valve will be kept open by both springs when the motor fails, allowing the vehicle to be at least driven out of danger. It will on the other hand also be possible to drive the vehicle to a repair shop. Another advantage is that the springs will not interfere with normal drive-by-wire operation. A properly operating motor can easily overcome the forces exerted by the springs and drive the engine while the valve is in the completely open, meaning full-load or idling, position.

The second embodiment is characterized by an emergency air supply system wherein a gas tank air injection valve on the housing and a fuel vapor cutout in the housing communicate with the second air flowthrough chamber and wherein the gas tank air injection valve can be activated when the motor fails in order to ensure that enough air is obtained from a gas tank or gas tank vapor elimination valve for the vehicle to be driven away.

The purpose of the gas tank air injection valve is to exploit vapor from the gas tank. When the motor fails and the gas tank air injection valve is activated, it will provide enough air to the air flowthrough chamber to ensure an ignitable mixture, and the vehicle can easily be driven out of danger or to a repair shop.

The third and final embodiment is characterized by an emergency air supply system wherein the valve positioning assembly accommodates at least one valve return spring and wherein the motor is a one-way motor that counteracts the motion of that spring, whereby the valve will ensure enough air when the motor fails for the vehicle to be driven away.

A "one-way motor" is to be understood herein in the very general sense of a motor that preferably exerts torque in only one direction, clockwise or counterclockwise.

A one-way motor in the form of a torque motor will ensure that the valve can be positioned only when the valve positioning assembly is operating properly. When the motor fails, the valve return spring will force the spring into a position that supplies enough air.

It will be of advantage when the valve can be maintained in any of three "limp-home points", the first above the idling position, the second below the closed position, and the third above the all-the way open position. These points ensure enough air when the valve positioning assembly or motor fails for the vehicle to be driven away.

The engine can accordingly attain speeds of 1000 to 2000 rpm and exert enough torque for the vehicle to be driven away.

It will also be of advantage for the valve return spring to be more powerful than the valve opening spring. This feature ensures that the valve will always be forced against the stop when the motor fails. Arrival from any position at a prescribed opening angle defined by the limp-home points will accordingly be ensured. The engine can accordingly be started. Both springs can on the other hand be equally powerful.

To constitute the second and third limp-home point, the torque motor can rotate the valve away from the all-the-way open position and toward the closed position or away from the closed position and toward the all-the-way open position.

It will also be of advantage for the valve opening spring, the valve return spring, and the valve return subassembly or subassemblies to be spiral springs. This approach will rotate the shaft. Such other energy-storage means as reservoirs of liquid or gas that also provide resilience can of course also be employed.

It is also of advantage, finally, for the valve positioning assembly to be accommodated in the housing or in its lid. In this event the appropriate control signals can be transmitted directly.

The gas tank air injection valve can be electromagnetically controlled and comprises an essentially annular coil accommodating a metal core that travels back and forth axially. The end of the core that faces the valve seat can be sealed with an elastomer. The core and the seal can interlock.

Lengthy testing has demonstrated that between 20 and 80 and preferably 40 kg of air an hour are employed during emergency operation.

The present invention will now be specified with reference to the accompanying drawing, stressing the advantages of the embodiments in accordance with the present invention.

DESCRIPTION OF THE PREFERRED EMBODIMENTS

Figure 1:
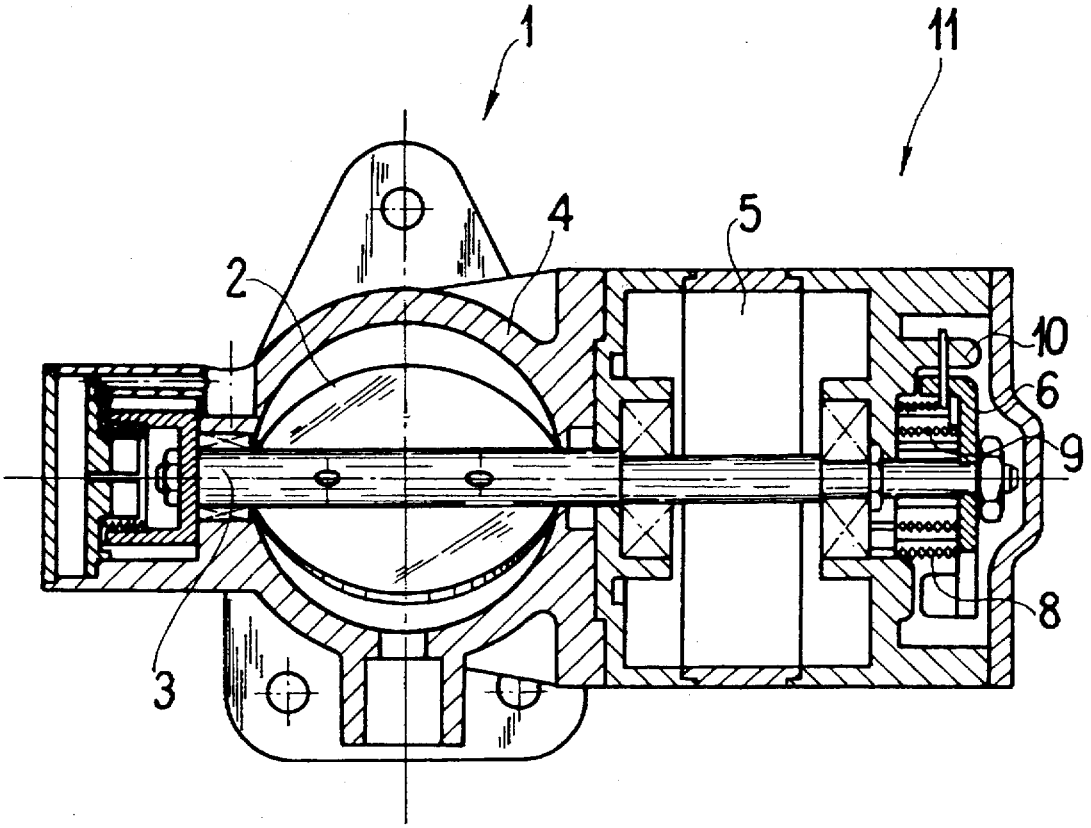
FIG. 1 is a schematic section through a throttle valve device with an emergency air supply system.

FIG. 1 illustrates part of a drive-by-wire system comprising a throttle valve assembly 1 and a valve positioning assembly 11 accommodated in one housing 4. A shaft 3 extends through housing 4. Attached to the shaft is a flap valve 2. Valve positioning assembly 11 comprises a motor 5, a valve return spring 8, and a valve opening spring 9. Motor 5 fits shaft 3 tightly.

Figure 2:
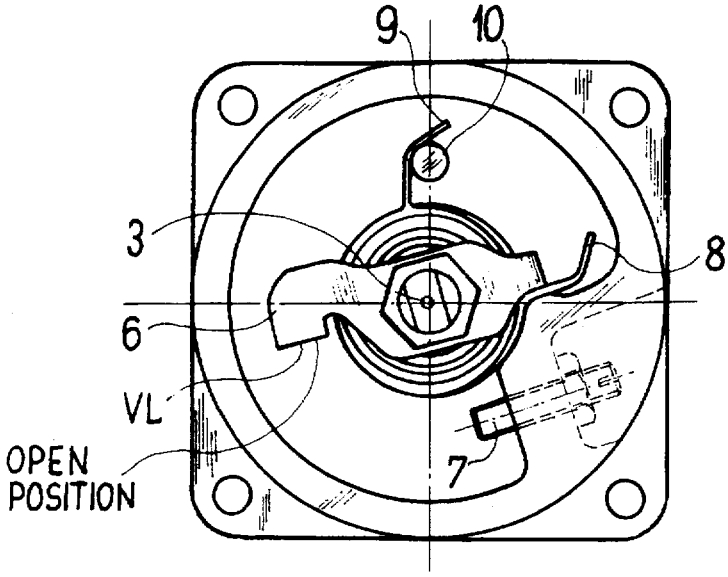
FIG. 2 is a schematic side view of an emergency air supply system with a stopping lever in the all-the-way open position.
Figure 3:
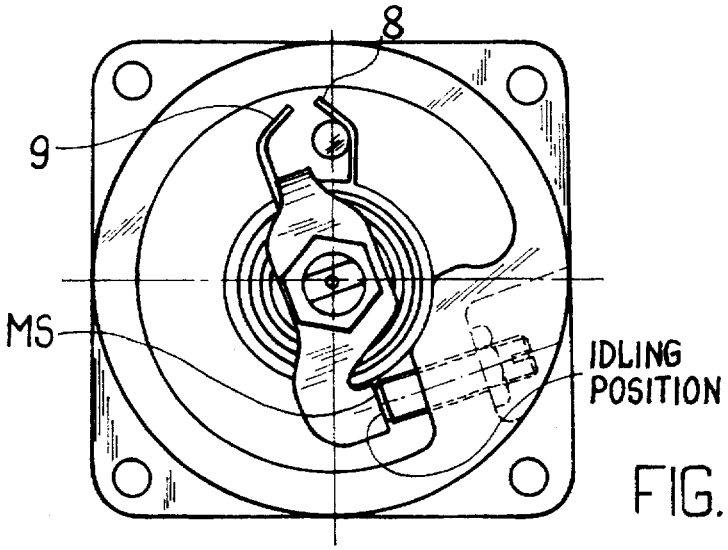
FIG. 3 is a schematic side view of an emergency air supply system in the idling state.
Figure 4:
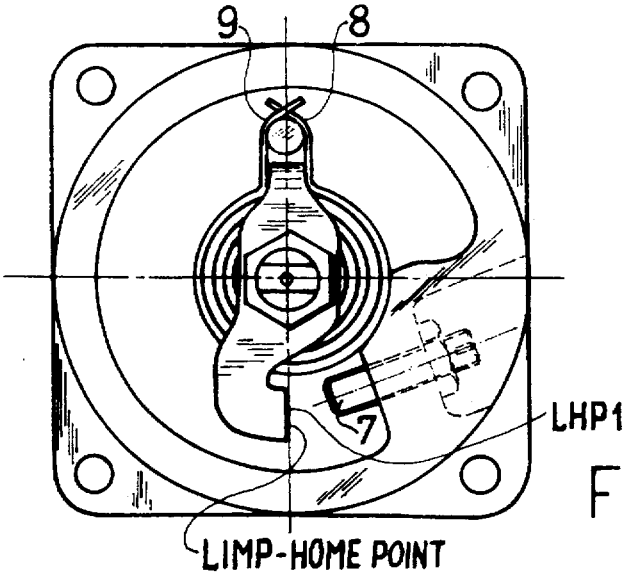
FIG. 4 is a schematic side view of an emergency air supply system at the limp-home point.

As will also be evident from FIGS. 2 through 4, both valve return spring 8 and valve opening spring 9 also fit shaft 3 tightly. Both springs are spiral springs and counteract each other. A pivoting lever 6 is also attached to shaft 3 and rests against a setscrew 7 that establishes an idling position MS.

How the emergency air-supply system illustrated in FIGS. 2 through 4 operates will now be specified.

When the pedal is depressed all the way, motor 5 will rotate valve 2 into the all-the-way open position VL, illustrated in FIG. 2. How far it opens is dictated by the position of pivoting lever 6. Valve return spring 8 is currently entirely disengaged and tensioned, with its angled end resting against pivoting lever 6. The opposite of all-the-way open position VL is idling position MS. Once motor 5 has rotated valve 2 into idling position MS, the engine will be able to idle. In this event the end of valve opening spring 9 will rest against pivoting lever 6 and the spring will be tensioned.

Since the vehicle cannot be driven while the valve is in idling position MS, it is essential to ensure that, when motor 5 fails, there will still be enough power left to drive to a repair shop or at least out of the way. The valve will simultaneously be rotated out of all-the-way open position VL by valve return spring 8 and out of the idling position and toward another stop 10 by the counteractive valve opening spring. The result will be a first limp-home point LHP1. Since valve return spring 8 has a more powerful moment than valve opening spring 9 does, the valve will always be forced against stop 10 in the absence of electricity. The valve will accordingly be positioned such as to raise the engine speed above idling position MS. This feature ensures that the limp-home point will always be established when motor 5 fails. Since pivoting lever 6 does not rest against a stationary stop at the limp-home point, it will also be ensured that the point can be reached from any position of valve 2. A further result is that provision of a specific first limp-home point LHP1 defined by the position of stop 10 will ensure smooth collaboration between valve assembly 1 and motor 5.

The load is reversed at first limp-home point LHP1 at the end of the shaft that faces the engine. This reversal, however, affects the engine's dynamics only slightly because motor 5 is an incremental direct-current or similar motor and accordingly depends on angle rather than load.

Figure 5:
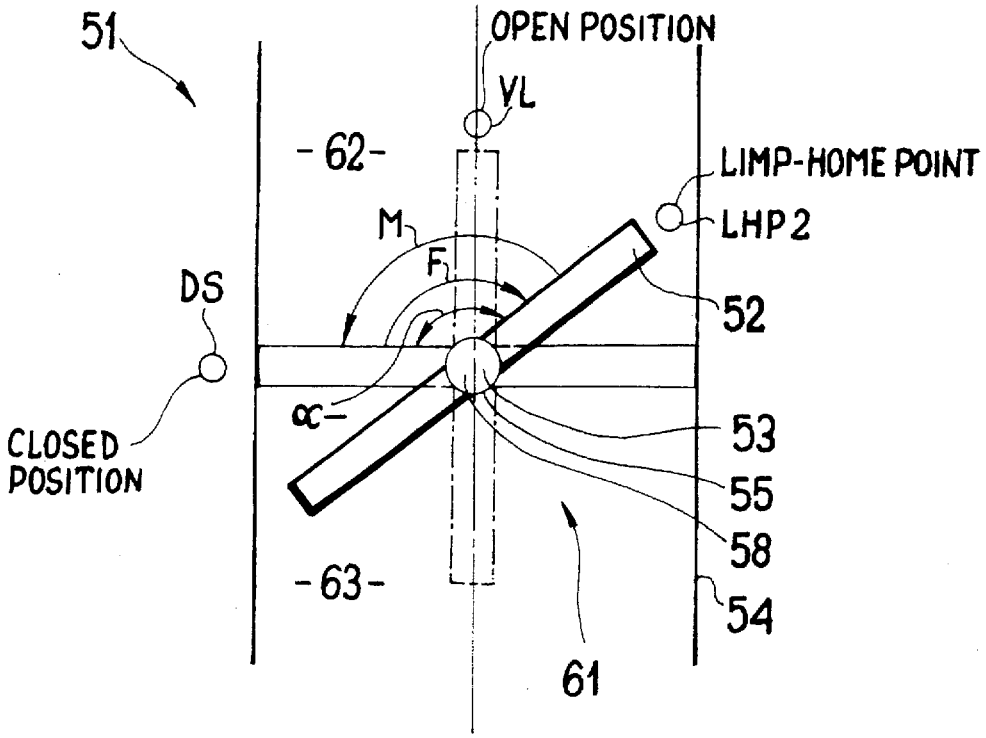
FIGS. 5 and 6 are different versions of a throttle valve device with different emergency air supply systems.

FIG. 5 illustrates another component of a drive-by-wire system that includes a valve assembly 51 and a valve positioning assembly 61.

Valve assembly 51 and a valve positioning assembly 61 are accommodated here as well in one housing 54. Housing 54 also accommodates a shaft 53, whereon is mounted a valve 52.

A valve positioning assembly 61 comprise a one-way torque motor 55 and a valve return spring 58. Motor 55 is tightly fastened to valve 52.

As will be evident from FIG. 5, the valve executes a resilient circular clockwise stroke F. Since motor 55 is a one-way motor, its own motion M is counterclockwise and opposes valve stroke F.

Valve 52 will assume a closed position DS once motor 55 has rotated its entire stroke. The result will be the creation of two air flowthrough chambers 62 and 63. Air flowthrough chamber 62 is above the valve and air flowthrough chamber 63 below it and toward the engine. If the force exerted by motor 55 decreases as necessary to drive the vehicle (at full load), resilient stroke F will be longer than motor stroke M, and valve 52 will rotate 90° into the perpendicular, which is all-the-way open position VL.

Figure 6:
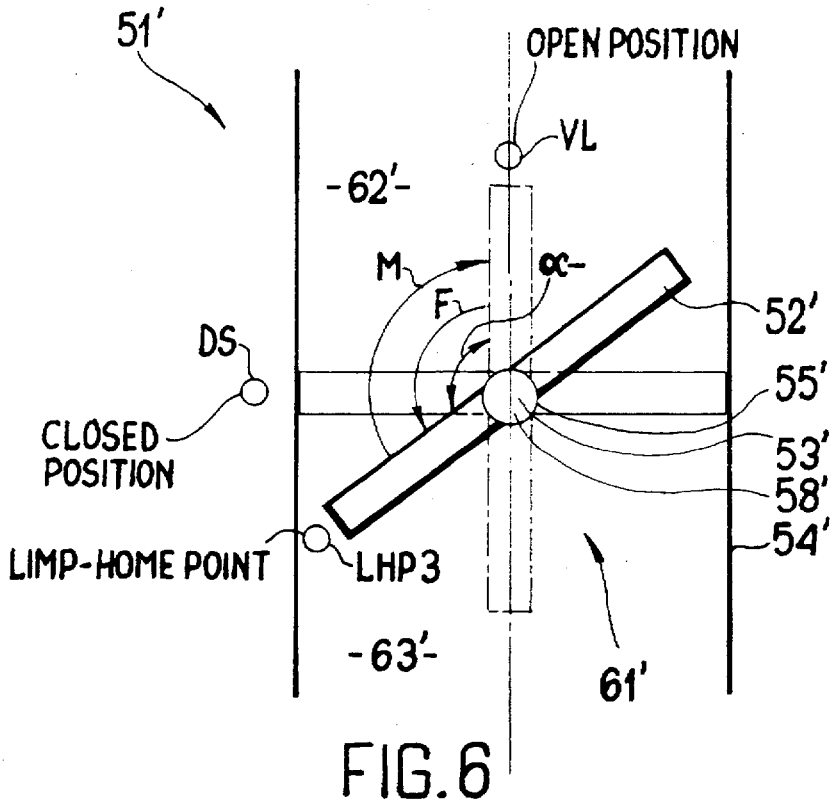

FIG. 6 illustrates a drive-by-wire system similar to the system illustrated in FIG. 5. It includes a valve assembly 51' and a valve positioning assembly 61'.

Valve assembly 51' is accommodated along with valve positioning assembly 61' in a housing 54'. A shaft 53' extends through and rotates inside housing 54'.

Valve positioning assembly 61' comprises a torque motor 55' and a valve closing spring 58'. Motor 55' fits tightly over a shaft 53'.

Motor 55' is one way and rotates clockwise. Valve closing spring or springs 58' describe on the other hand a counterclockwise stroke F. Operation in conjunction with motor 55' also allows the valve to be rotated from closed position DS to all-the-way open position VL. When the valve is in the closed position, there is one air flowthrough chamber 62' above and another air flowthrough chamber 63' below it. When the valve is in all-the-way open position VL, chambers 62' and 63' communicate.

How the emergency air-supply system illustrated in FIGS. 5 and 6 operates will now be specified.

In normal operation, motor 55 rotates, as will be evident from FIG. 5, the valve between closed position DS (minimal air flow) and all-the-way open position VL (maximal air flow). The resulting variation in flow increases or decreases the torque exerted by motor 55 until it completely overcomes, neutralizes, or drops below the force of valve closing spring or springs 58. When the supply of electricity to motor 55 is interrupted or when the motor is disengaged, valve closing spring or springs 58 will rotate valve 52 $\alpha+$ away from closed position DS, beyond all-the-way open position VL, and against the stop at second limp-home point LHP2.

The valve in the version illustrated in FIG. 6 rotates in normal operation between closed position DS (minimal air flow) and all-the-way open position VL (maximal air flow). When the supply of electricity to motor 55 is interrupted or when the motor fails, valve closing spring or springs 58' will rotate the valve α+ beyond closed position DS to a third limp-home point LHP3.

Figure 8A:
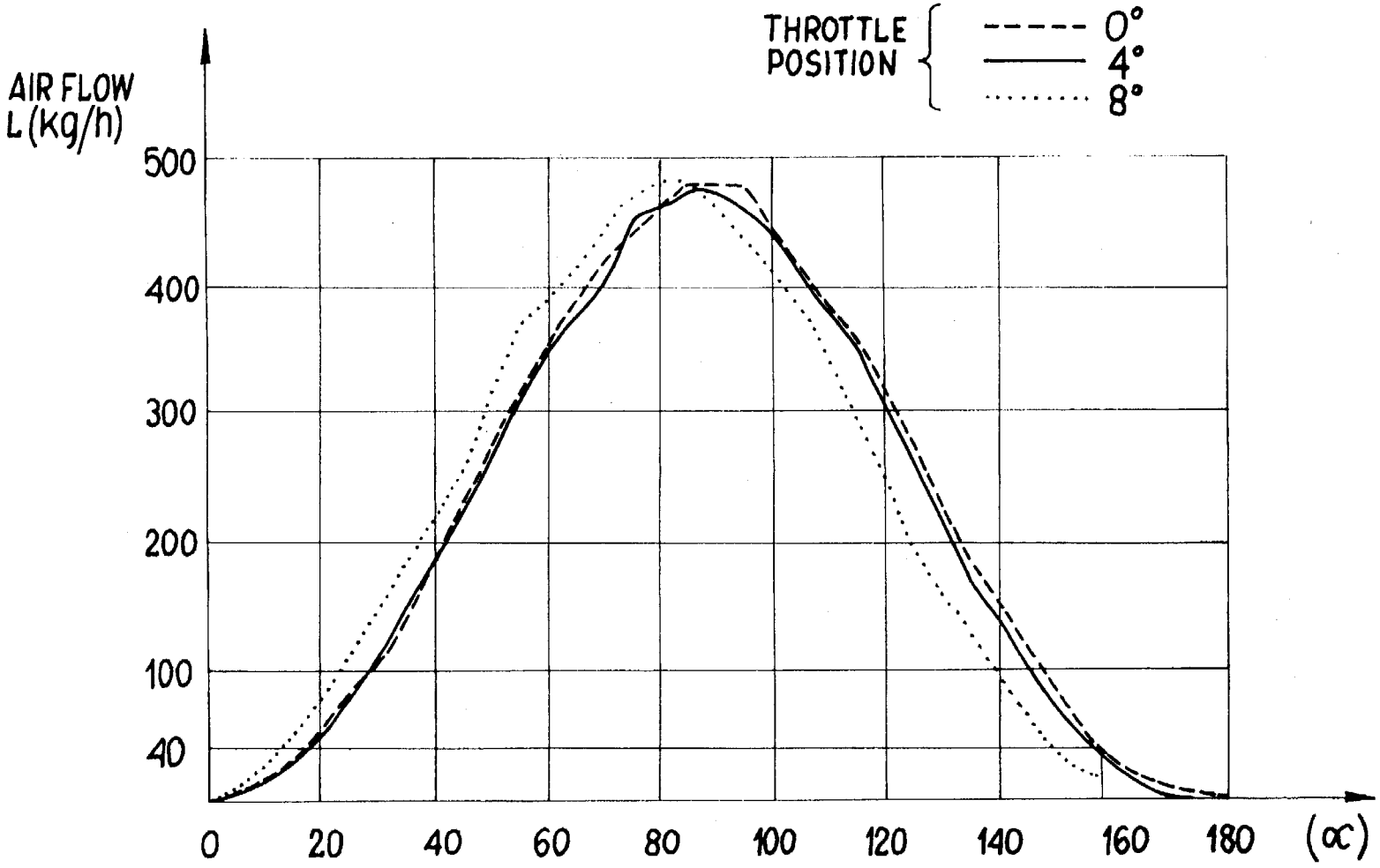
FIGS. 8*a* and 8*b* are graphs of air flow as a function of valve position.
Figure 8B:
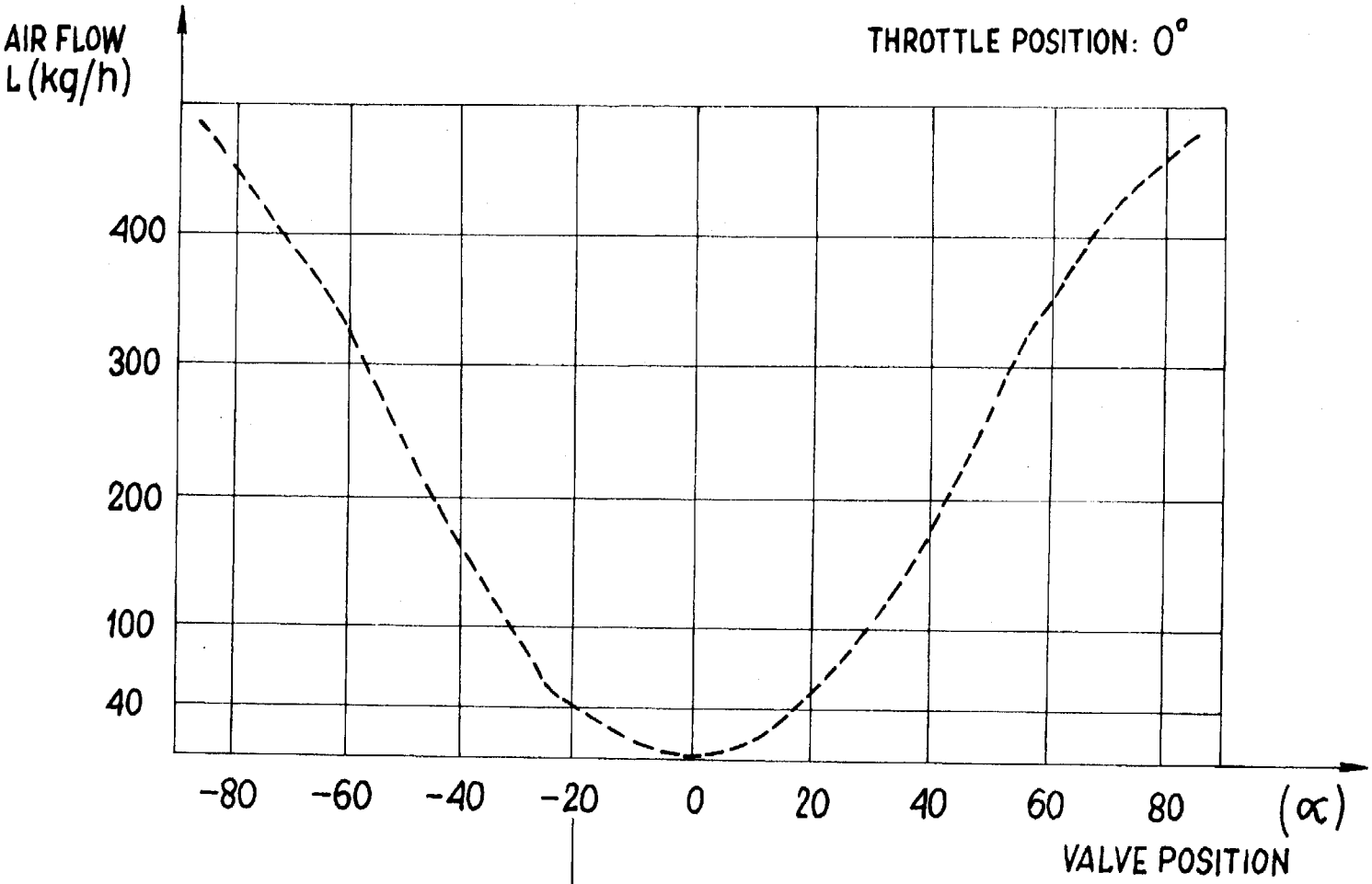

FIGS. 8*a* and 8*b* are graphs illustrating air flow as a function of valve angle α.

The empirical curves were plotted with a cylindrical valve 40 mm in diameter at 0° in a cylindrical connection 40 mm in diameter. There was a vacuum of 364 mm/Hg with the valve closed. There were 40 kg of air an hour at the limp-home point.

The curve is an inverted bell curve with a minimum at 0° and approximately 0 kg of air an hour and with maximal air flow at 90° and approximately 480 kg of air an hour.

The tests and series of tests surprisingly reveal that, in order to allow the engine to operate in an emergency, valve 52 or 52' must be set to allow approximately 40 kg of air an hour to flow from air flowthrough chamber 62 or 62' to air flowthrough chamber 63 or 63'. With a closed position DS of approximately 0°, the angle α+ of the second limp-home point LHP2 in a system of the type illustrated in FIG. 5 will as is evident from FIG. 8*a* be approximately 158°. If the valve is advanced approximately 4°, second limp-home point LHP2 will be at approximately 157°, and if it is advanced approximately 8°, the limp-home point will be at approximately 149°. This feature ensures that the valve cannot seize up or jam in closed position DS.

In a system of the type illustrated in FIG. 6, third limp-home point LHP3 will, as will be evident from FIG. 8*b*, occur at a valve angle α+ of −21°.

The relation between the requisite flow of air at the limp-home point of approximately 40 kg an hour on the one hand and the valve angle on the other is similarly valid for the system specified with reference to FIGS. 1 through 4. Springs 8 and 9 must in this case be adjusted to draw valve 2 to an angle of approximately 21° to ensure adequate air flow.

Figure 9:
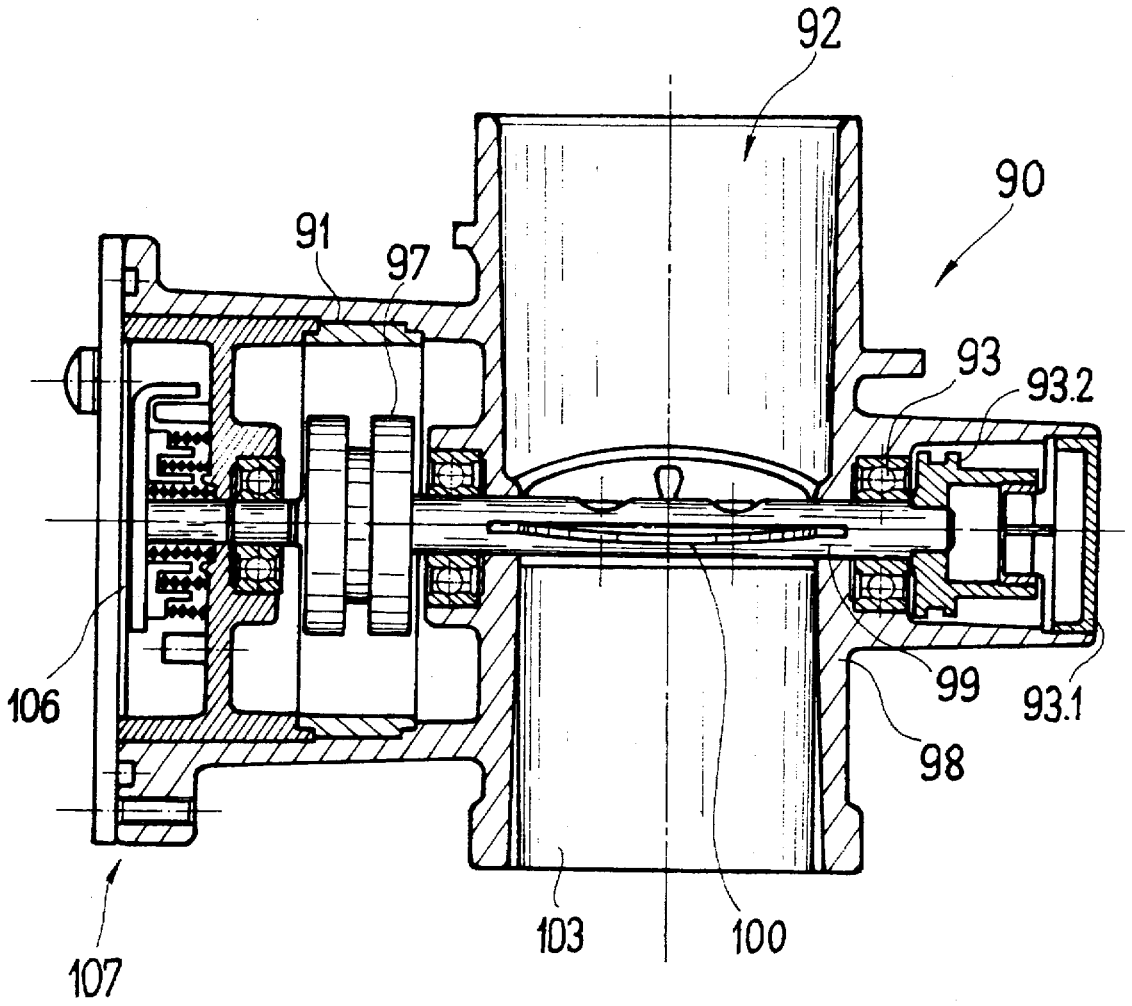
FIG. 9 is a schematic section through a throttle valve device with another type of emergency air supply system.
Figure 10:
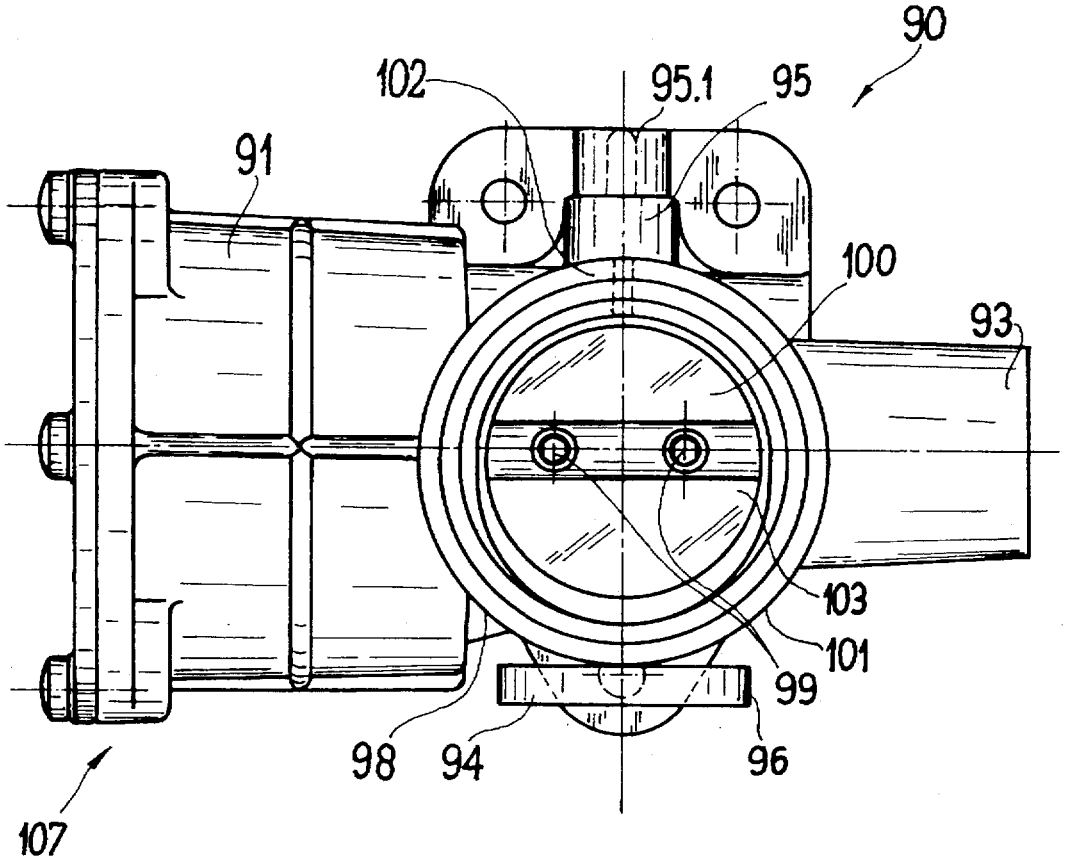
FIG. 10 is another illustration of the device illustrated in FIG. 9.

FIGS. 9 and 10 illustrate another section of a drive-by-wire system.

This section comprises a throttle valve 90 and a valve positioning assembly 107.

Valve 90 and 107 are both accommodated in a housing 98. Housing 98 also accommodates a shaft 99. Mounted on shaft 99 is a flap valve 100. While in a closed position DS, valve 100 separates one air flowthrough chamber 92 from another air flowthrough chamber 103. Shaft 99 is attached to valve positioning assembly 107. Valve positioning assembly 107 is constituted by a stepping motor 91 that is attached to shaft 99 by a rotor 97. Integrated into valve positioning assembly 107 is a valve returning mechanism that ensures the return of the valve to its closed position DS once it has been rotated. The valve returning mechanism can for example be a spring. Secured to the opposite end of shaft 99 is an angle detector 93. Angle detector 93 comprises a stationary component 93.1 and a rotating component 93.2. Rotating angle detector component 93.2 is attached to the valve, and stationary angle detector component 93.1 is accommodated in housing 98. Housing 98 also accommodates, as will be evident from FIG. 10, a gas tank air injection valve 95. Gas tank air injection valve 95 includes a connection 95.1 for a rubber hose. The hose communicates via a power vapor opening 102 with the inside of the gas mixing cavity 103. The particular purpose of gas-tank air injection valve 95 is to introduce vapor emitted by the tank or from its activated carbon filter. It is an electromagnetic (AKF) valve comprising a coil and a magnetizable core that travels in and out of the coil. The end of the core facing the seat of the valve is provided with an elastomeric seal. The coil and seal interlock. This valve is an assembly of the type specified in the European Patent No. 0,623,772 A2 in particular.

Opposite gas-tank air injection valve 95 is a central plug 96. Housing 98 accommodates a channel 101 and valve 106. Valve controls 106 are, as will be evident from FIG. 9, positioned immediately behind the stepping motor 91.

Figure 7A:
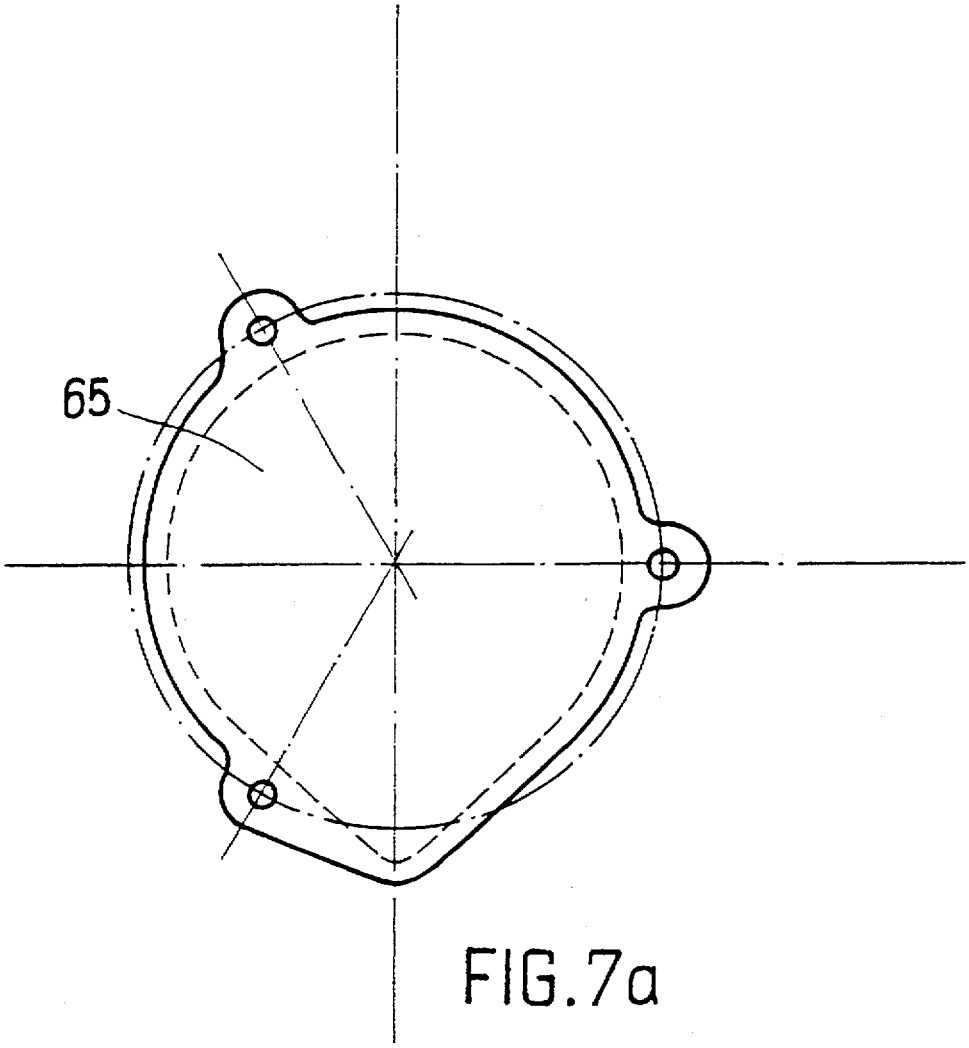
FIGS. 7*a* and 7*b* illustrate one version of a valve positioning assembly that can be accommodated in the device.
Figure 7B:
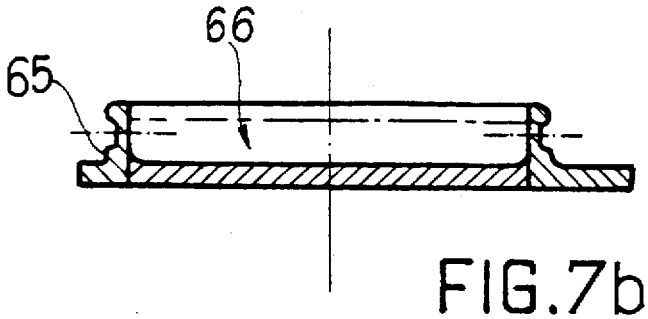

FIGS. 7*a* and 7*b* illustrate another way of accommodating controls 66. Here they are accommodated in the lid 65 of the housing. It is essential for both controls 66 and lid 65 to be totally integrated components of the device and protected from outside aggression. Any electrical connections that need to be accommodated inside the housing can be protected by extending them through channel 101 and out at the center through central plug 96. To also protect a temperature detector 94, it can be accommodated inside central plug 96.

How the emergency air-supply system illustrated in FIGS. 9 and 10 operates will now be specified.

When the pedal is depressed, it emits a signal that is transmitted to valve controls 106. Motor 91 and rotor 97 rotate the valve from closed position DS to all-the-way open position VL. This feature ensures enough air for an adequate mixture. Angle detector 93 measures the angle for use in the further processing.

If motor 91 fails, the appropriate valve returning components will return valve 100 to closed position DS. The gas tank air injection valve will be engaged by an emergency operation signal. The signal will keep gas tank air injection valve 95 open wide enough to ensure a flow of approximately 40 kg of air an hour. This air will be supplied to air flowthrough chamber 103 from the tank or through an activated carbon filter in the tank's air escape. The air will be adequate, as specified hereintofore, for the vehicle to be driven out of danger or to a repair shop. Gas tank air injection valve 95 should be actuated in accordance with the other conventional signals. It must be ensured that, even in the event of motor failure or of interruption of electricity to throttle valve assembly 90, the gas tank air injection valve 95 can be engaged independently.

There has thus been shown and described a novel throttle valve device which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a throttle valve device for a motor vehicle engine comprising a housing, a shaft, a throttle valve, two air flowthrough chambers, and a valve positioning assembly, wherein the valve is accommodated between the air flowthrough chambers, the second air flowthrough chamber communicates with the vehicle engine, the valve positioning assembly is attached to the valve and rotates it between at least one closed position (DS), an idling position (MS), and an all-the-way open position (VS), and the valve positioning assembly includes at least one stepping motor, the improvement wherein the second air flowthrough chamber communicates with an emergency air supply system that allows the vehicle to be driven away even when the motor fails and wherein the valve positioning assembly accommodates a valve return spring and an opposing valve opening spring, both of which fit the shaft tightly, so that the valve return spring is tensioned against a stop as long as the motor maintains the shaft rotated in the opening direction, and so that the valve opening spring is tensioned against the stop as long as the motor maintains the shaft rotated into the idling direction, wherein the valve will assume a position (LHP1) when the motor fails that will allow enough air through for the vehicle to be driven and wherein a gas tank air injection valve on the housing and a fuel vapor cutout in the housing communicate with the second air flowthrough chamber and wherein the gas tank air injection valve can be activated when the motor fails in order to ensure that enough air is obtained from a gas tank or gas tank vapor elimination valve for the vehicle to be driven away.

2. The device defined in claim 1, further comprising an emergency air supply system wherein the valve positioning assembly accommodates at least one valve return spring and wherein the motor is a one-way motor that counteracts the motion of that spring, whereby the valve will ensure enough air when the motor fails for the vehicle to be driven away.

3. The device defined in claim 1, wherein the valve is maintained at the point (LHP1) above the idling position (MS) that ensures enough air when the valve positioning assembly or motor fail for the vehicle to be driven away.

4. The device defined in claim 1, wherein the valve return spring is more powerful than the valve opening spring.

5. The device defined in claim 1, wherein the torque motor can rotate the valve away from the all-the-way open position (VL) and toward the closed position (DS) or away from the closed position and toward the all-the-way open position.

6. The device defined in claim 1, wherein the valve opening spring, the valve return spring, and the valve return subassembly or subassemblies are spiral springs.

7. The device defined in claim 1, wherein the gas tank air injection valve can be electromagnetically controlled and comprises an essentially annular coil accommodating a metal core that travels back and forth axially, whereby the end of the core that faces the valve seat can be sealed with an elastomer and the core and the seal interlock.

8. The device defined in claim 1, wherein the valve positioning assembly is accommodated in the housing or in its lid.

9. The device defined in claim 1, wherein between 20 and 80 kg of air an hour are employed during emergency operation.

10. The device defined in claim 1, wherein approximately 40 kg of air an hour are employed during emergency operation.

11. The device defined in claim 1, wherein the valve is maintained at the point below the closed position (DS), that ensures enough air when the valve positioning assembly or motor fail for the vehicle to be driven away.

12. The device defined in claim 1, wherein the valve is maintained at the point above the all-the-way open position (VL), that ensures enough air when the valve positioning assembly or motor fail for the vehicle to be driven away.

* * * * *